US006234775B1

(12) United States Patent
Agner et al.

(10) Patent No.: US 6,234,775 B1
(45) Date of Patent: May 22, 2001

(54) PUMP WITH DEFORMABLE THRUST PLATE

(75) Inventors: Ivo Agner, Bad Homburg; Hans-Jurgen Lauth, Neu-Anspach, both of (DE)

(73) Assignee: LuK Fahrzeug-Hydraulik GmbH & Co., KG (DE)

( * ) Notice: Subject to any disclaimer, the term of this patent is extended or adjusted under 35 U.S.C. 154(b) by 0 days.

(21) Appl. No.: 09/236,999

(22) Filed: Jan. 25, 1999

(30) Foreign Application Priority Data

Jan. 23, 1998 (DE) ..... 198 02 443

(51) Int. Cl.[7] ..... F01C 19/08

(52) U.S. Cl. ..... 418/132; 418/133; 418/72; 418/78

(58) Field of Search ..... 418/133, 132, 418/72, 78

(56) References Cited

U.S. PATENT DOCUMENTS

| | | | | |
|---|---|---|---|---|
| 3,311,064 | * | 3/1967 | Eichele et al. | 418/133 |
| 4,309,158 | * | 1/1982 | Grabow et al. | 418/132 |
| 4,382,756 | * | 5/1983 | Chronowski et al. | 418/133 |
| 4,416,598 | * | 11/1983 | Merz | 418/132 |
| 5,046,933 | * | 9/1991 | Haga et al. | 418/78 |
| 5,178,528 | * | 1/1993 | Malfit | 418/72 |
| 5,266,018 | * | 11/1993 | Niemiec | 418/82 |
| 6,050,796 | * | 4/2000 | Wong et al. | 418/132 |

FOREIGN PATENT DOCUMENTS

| | | |
|---|---|---|
| 4124466A1 | 1/1993 | (DE) . |
| 0095140 | 11/1983 | (EP) . |
| 1415544 | 11/1975 | (GB) . |
| 1500107 | 2/1978 | (GB) . |
| 2016601 | 9/1979 | (GB) . |
| 1573881 | 8/1980 | (GB) . |
| 2097862 | 11/1982 | (GB) . |
| 9805864 | 2/1998 | (WO) . |

* cited by examiner

*Primary Examiner*—Thomas Denion
*Assistant Examiner*—Thai-Ba Trieu
(74) *Attorney, Agent, or Firm*—Ostrolenk, Faber, Gerb & Soffen, LLP

(57) ABSTRACT

A pump comprises a housing and a pump unit arranged therein. The pump unit comprises a first and a second thrust plate and a ring arranged therebetween and having a through opening. The ring rests on the two thrust plates at least at an outer peripheral region thereof, and a pressure chamber is formed between the second thrust plate and the housing. A spacer supports the first thrust plate at a distance from the housing, and the spacer is associated at least in part with a radially inner surface area of the first thrust plate opposite the through opening. This allows deformation of the first thrust plate under operational pressure so as to hinder formation of a gap between the thrust plate and the pump insert.

24 Claims, 6 Drawing Sheets

PUMP WITH DEFORMABLE THRUST PLATE

BACKGROUND OF THE INVENTION

The present invention relates to a pump comprising a housing and a pump unit arranged therein, the pump unit comprising a first and a second thrust plate and a ring arranged therebetween and having a through opening, at least at an outer peripheral region of the ring resting on the two thrust plates, a pressure chamber being formed between the second thrust plate and the housing.

Pumps of the type described above are known. The pump is provided with a housing which receives a pump unit. The pump unit comprises a first and a second thrust plate, between which a ring is arranged. A pump chamber is thus formed in which a pump insert is arranged which comprises movable parts for drawing in and compressing a medium. During operation of the pump the movable parts of the pump insert are moved along the inside of the ring and/or the thrust plates. It has been found that the compressed medium deforms the thrust plates. In particular, the thrust plates bulge outwards. A gap is thus formed between the movable parts of the pump insert and the thrust plates. As a result, a shortcircuit is effectively produced between the pressure region and the suction region of the pump, so that the medium conveyed can flow out of the pressure region into the suction region. This has an adverse effect upon the volumetric efficiency of the pump.

In order to improve the efficiency of such a pump, the side of one thrust plate remote from the pump chamber is acted upon with the fluid pressure from the pressure region. The other thrust plate is supported on a face of the housing. That face of the housing has to be made particularly flat so that the thrust plate rests uniformly thereon. In this case the housing is formed by a cup-shaped housing half and by a plane housing lid which is provided with the flat face. A disadvantage of this is that the flat face of the lid can be produced only at a substantial cost. In addition, the entire housing, and in particular the lid, has to be constructed with a particularly high degree of rigidity, so that it can act as an abutment for the thrust plate.

In other known pumps, in order to improve efficiency, the side of the two thrust plates remote from the pump chamber is acted upon with the fluid pressure from the pressure region. This has the disadvantage that an additional cost for sealing is required in order to be able to supply the thrust plates from outside with the medium acted upon with pressure.

SUMMARY OF THE INVENTION

An object of the invention is therefore to provide a pump as described above which does not have the known disadvantages.

The invention provides a pump comprising a housing and a pump unit arranged therein. The pump unit comprises a first and a second thrust plate and a ring arranged therebetween and having a through opening. The ring rests on the two thrust plates at least at an outer peripheral region thereof. A pressure chamber is formed between the second thrust plate and the housing. Spacer means are provided to support the first thrust plate at a distance from the housing. The spacer means are associated at least in part with a radially inner surface area of the first thrust plate opposite the through opening.

During operation of the pump the second thrust plate acted upon with fluid pressure from the pressure chamber is displaced towards the ring. The ring presses against the facing side of the first thrust plate which is thereby deformed in the manner of a cup spring, since it is supported at its other side on the spacer means. In particular, the thrust plate is deformed in such a way that the inner surface area facing the pump chamber is displaced towards the pump insert, so as substantially to prevent the formation of a gap between the first thrust plate and the pump insert. As a result, the volumetric efficiency of the pump is improved. In addition, it is advantageous that because of the spacer means, a particularly precise machining of the housing is no longer necessary in that region in which the first thrust plate is supported by the spacer means. In known pumps a particularly flat design of this region was required so that the first thrust plate should rest or should be pressed uniformly against the ring and the pump insert.

In addition, in the pump according to the invention, it is advantageous that it is no longer necessary for the two thrust plates to be acted upon with the fluid pressure from the pressure region. As a result, the pump can be produced in a simple and inexpensive manner, since an outlay with respect to sealing need not be made for both of the thrust plates, as is required in the case of known pumps.

In a preferred embodiment the spacer means is made flat. This means that the face of the spacer means, on which the first thrust plate rests, is situated in one plane. As a result, the first thrust plate is deformed uniformly during operation of the pump. Alternatively, it is also possible, however, for the height of the spacer means to be varied in part. As a result, the deformation of the first thrust plate can be adapted to the suction regions and pressure regions of the pump. This means that the spacer means can have a lower height in the suction region than in the pressure region. As a result, the compensation of the gap can be adapted as a function of the pressure prevailing in the pump chamber or in the suction regions and pressure regions respectively. In addition, in a spacer means of differing height the lower portion of the spacer means is associated with the outer surface area of the first thrust plate. The lower portion acts as a stop for the first thrust plate when the maximum desired bending of the first thrust plate has been achieved. It is also possible, of course, to alter the position of the spacer means. This means that a position of the spacer means can be varied with respect to its distance from a drive shaft of the pump. As a result, it is possible to vary the effective lever arm of the thrust plate between the abutment region of the ring and the spacer means. In this way, the degree of deformation of the thrust plate can be altered.

In a further preferred embodiment the housing is provided with a cup-shaped recess which receives the first thrust plate at least in part. Since the housing can comprise two parts, the depth of the cup-shaped recess which receives the pump unit can be varied and so the separation plane between the housing parts can be shifted. A specially flat area on the base of the cup for forming an abutment for the first thrust plate is not necessary in the pump according to the invention. It is also advantageous that the housing of the pump according to the invention need not be constructed with a particularly high degree of rigidity, since deformation of the housing does not result in an increased formation of a gap between the movable parts of the pump insert and the thrust plates. This means that, since the second thrust plate acts upon the ring which in turn exerts a force upon the first thrust plate, the pump unit can be displaced inside the housing, so that yielding of the housing as a result of deformation is compensated by the pump unit following after.

In a preferred embodiment the spacer means is made continuous, and in particular as a closed curve.

In this way, a particularly uniform abutment face can be produced, so that the first thrust plate is deformed uniformly during the operation of the pump. In particular, the spacer means may have an annular or oval curve shape. As a result, adaptation to different cross-sections or profiles of the ring or the through opening is possible. The radius of the continuous spacer means can of course be varied, so that in this case too it is made possible to alter the effective lever arm.

In a preferred embodiment, the first thrust plate and the housing together with the spacer means bound a space in the radial direction which is connected to the pressure region by a fluid connection. As a result, the deformation of the first thrust plate during operation can be deformed in addition to the application of force by the ring. It is therefore possible to compensate a gap at particularly high fluid pressures.

In a particularly preferred embodiment a fluid connection, which connects the space enclosed by the spacer means to the pressure chamber of the pump, is provided in the first thrust plate. In this way, it is possible to act upon the first thrust plate with pressure in a particularly simple manner.

In a further preferred embodiment the fluid connection in the first thrust plate is arranged in a region situated radially outwardly, and in the operational position of the pump the fluid connection is situated outside a median axis of the pump insert. This embodiment is advantageous in that problems of venting do not occur when the pump is initially started up.

In a particularly preferred embodiment the spacer means is formed by a bead extending from the base of a cup-shaped recess of the housing. The bead may be formed integrally with the housing. Alternatively, the spacer means, and in particular the bead, is formed integrally with the first thrust plate.

In a preferred embodiment the bead is provided with a seal. This is advantageous in particular in the embodiment in which the pressure is supplied from the pressure chamber into the space behind the thrust plate.

In a further particularly preferred embodiment the spacer means is formed by a ring situated between the base of the cup-shaped recess and the first thrust plate. This is advantageous if the thrust plate is moved during operation of the pump, since it can then roll on the, preferably open, ring. This has a particularly beneficial effect upon the life of the thrust plate on account of the low degree of wear.

In a further particularly preferred embodiment the ring has an angular, and in particular a quadrangular or trapezoidal, cross-section. In this case one edge of the ring of angular cross-section faces the first thrust plate. As a result, a linear abutment is produced between the spacer means and the first thrust plate. The desired lever arm can thus be adjusted in a particularly precise manner.

In a preferred embodiment the pump is a vane-cell pump, in which case the ring forms the lifting ring. The pump insert comprises a rotatably mounted rotor which receives—at least in part—vanes movable in the radial direction.

BRIEF DESCRIPTION OF THE DRAWINGS

Embodiments of the invention are now described with reference to the accompanying drawings, in which.

DETAILED DESCRIPTION OF THE INVENTION

In the following description, it is assumed as an example that the pump is a vane-cell pump. Other designs of a pump are also of course possible, for example a roller-cell pump or a gear pump which can be constructed in the form of a so-called cycloid pump.

Figure 1:
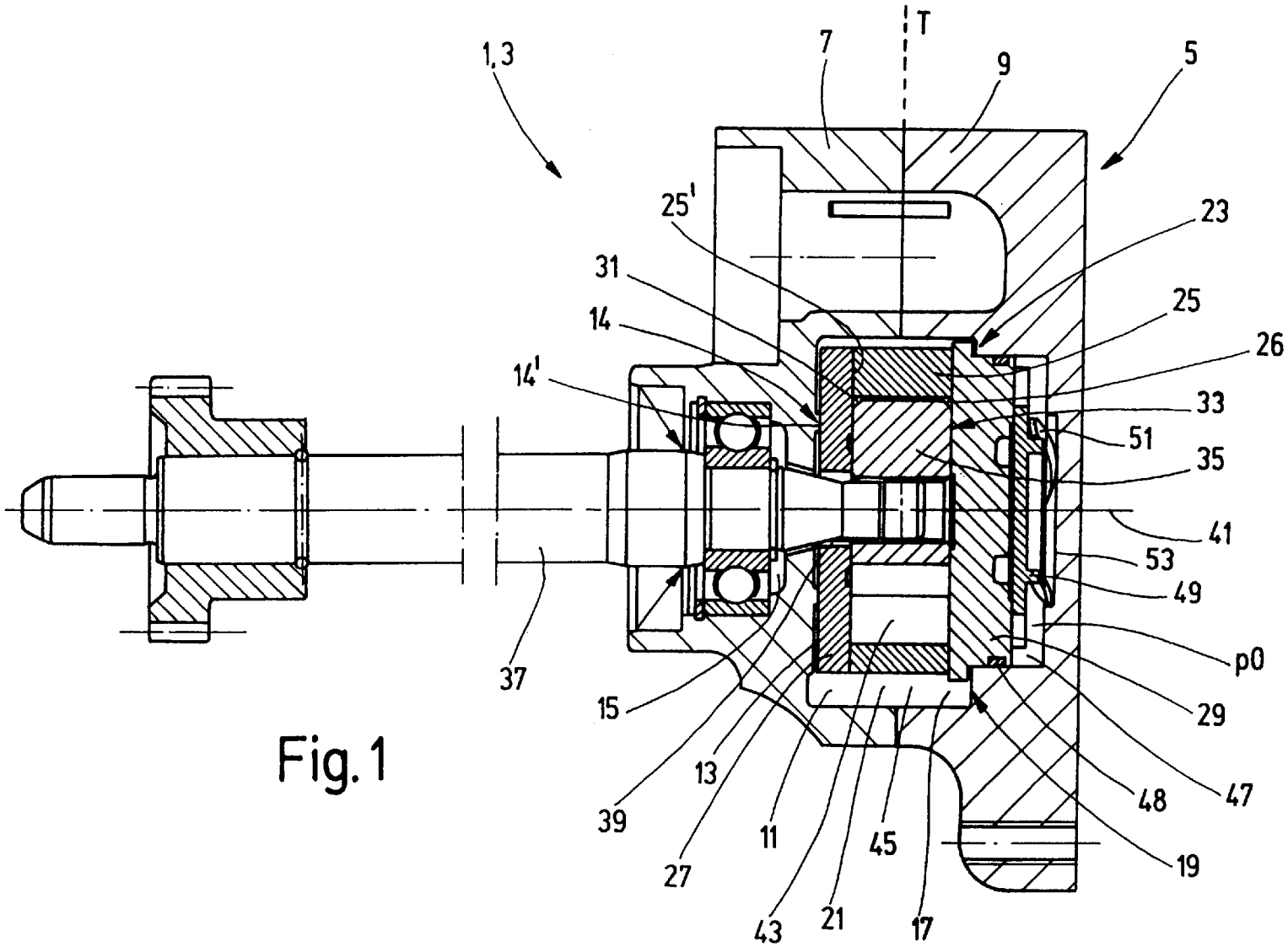
FIGS. 1 to 3 each show in longitudinal section an embodiment of a pump.

FIG. 1 shows a pump 1 which is constructed in the form of a vane-cell pump 3. Vane-cell pumps of the type in question are known, so that only the essential features will be discussed in detail at this point. The vane-cell pump 3 illustrated in section has a housing 5 which is formed by two parts 7 and 9. A cup-shaped recess 11, in the base 13 of which a stepped aperture 15 is provided, is formed in the housing part 7. An axially extending spacer means 14, which in this case is formed integrally with the housing part 7, is arranged on the base 13 of the recess 11. The spacer means is preferably constructed in the form of a continuous bead 14'. The bead 14' can be formed as a continuous curve which can be open or closed. It is also possible, of course, for the spacer means 14 to be constructed in the form of at least one point-shaped raised portion.

A recess 17, which comprises an annular step 19, is provided in the housing part 9. A housing interior 21, which receives a pump unit 23, is formed by the recess 11 in the housing part 7 and the recess 17 in the housing part 9. It is also possible, however, for the housing parts 7 and 9 to be designed in such a way that only one recess is provided in one housing part 7 or 9, the said recess then being covered by the other housing part 9 or 7, respectively, which is formed as a flat lid. The position of a separating joint T between the housing parts 7 and 9 is thus variable and can be selected in accordance with requirements. This means that the depth of the recesses 11 and 17 can be varied. In this case the depth of one recess 11 or 17 can be zero. This means that one cup-shaped recess 11 or 17 respectively is provided and is covered by a lid.

The pump unit 23 comprises a lifting ring 25, which is provided with a through opening 26 and which has associated therewith a first thrust plate 27 on one side of the through opening and a second thrust plate 29 on the other side of the through opening, so that a pump chamber 31 is formed in the interior of the lifting ring 25. The thrust plates 27 and 29 thus rest on an axially outer surface area 25' of the lifting ring 25. The first thrust plate 27 is supported on the bead 14' on its side remote from the lifting ring 25. The bead 14', or the spacer means 14, is preferably arranged in an axially inner surface area of the first thrust plate 27 which is opposite the through opening 26 of the lifting ring 25.

A pump insert 33, which is provided with a rotatably mounted rotor 35, is arranged in the pump chamber 31. The rotor 35 is driven by a drive shaft 37 which extends through the aperture 15 and through an aperture 39 formed in the first thrust plate 27, so that the drive shaft 37 can be brought into engagement with the rotor 35. The rotor 35 has slots formed therein which extend in a radial direction with respect to its axis of rotation 41 and into which radially movable vanes 43 are inserted. As the rotor 35 rotates inside the lifting ring 25, partial spaces are produced which become larger or smaller and which form at least one suction region and one pressure region. As the rotor 35 rotates, medium, for example oil, is conveyed out of a suction chamber 45 having a suction connection into a pressure chamber 47 having a pressure connection and connected to a consumer (not shown). The pressure chamber 47 is sealed off from the suction chamber 45 by a seal 48 inserted into the second thrust plate 29. A cold-start plate 49, which rests with one side thereof against the second thrust plate 29, is arranged in the pressure chamber 47. The other side of the cold-start plate 49 is supported on a base 53 of the recess 17 by a spring device 51. The spring device 51 urges the second thrust plate 29 to the left as viewed in FIG. 1. As a result, the second thrust plate 29 does not rest on the annular step 19.

During operation of the vane-cell pump 3 an operating pressure p0 is present in the pressure chamber 47. The operating pressure p0 acts upon the second thrust plate 29, so that a dynamic effect—towards the left in FIG. 1—is produced. This force is transmitted to the lifting ring 25 and thereby to the radially outer region of the first thrust plate 27. As a result, the first thrust plate 27 is deformed in such a way that the radially outer region is displaced towards the left in FIG. 1. This is possible since the first thrust plate 27 rests on the bead 14' and is spaced from the base 13 of the recess 11. Since the radially outer region of the first thrust plate 27 moves towards the left, the radially inner region of the first thrust plate 27 is deformed in the manner of a cup spring. This means that the radially inner region is displaced towards the right and abuts in a sealing manner against the rotor 35 or against the vanes 43. In this way, the formation of a gap between the rotor 35 or the vanes 43 and the first thrust plate 27 is substantially prevented. Thus, the oil present in the pressure region of the pump chamber 31 essentially cannot flow into the suction region of the pump chamber 31. The oil flow between the pressure region and the suction region is thus made more difficult. The said pump 1 therefore has a high degree of volumetric efficiency.

It is immediately clear that the entire pump unit 23 can be displaced in the housing 5 in such a way that, if the housing is deformed, the pump unit 23 follows thereafter, so that the gap between the rotor 35 and the thrust plates 27 and 29 is nevertheless compensated. The housing 5 of the pump 1 need not therefore be designed to have a particularly high degree of rigidity.

Figure 2:
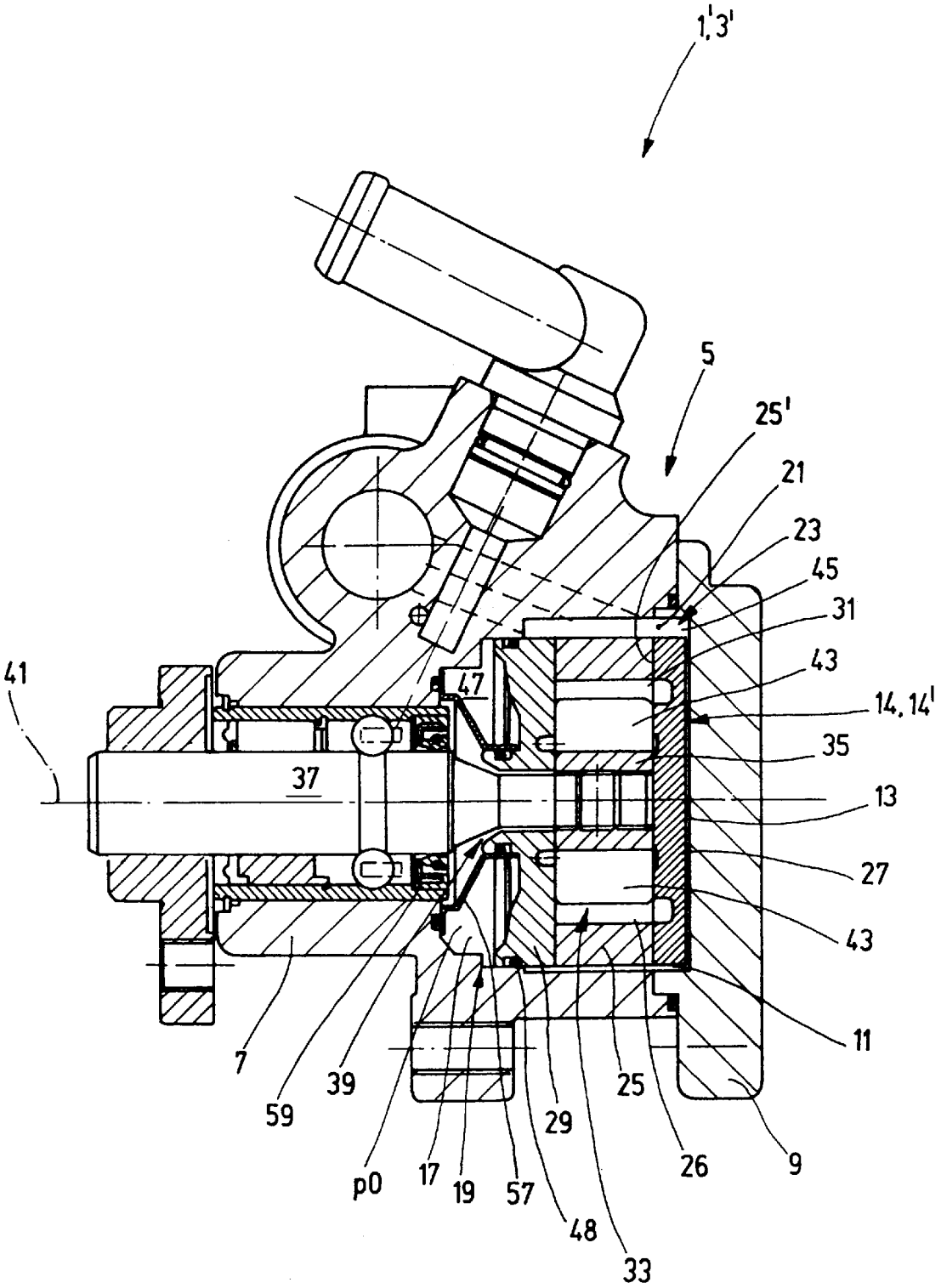

A further embodiment of a pump 1', which is constructed in the form of a vane-cell pump 3', is illustrated in FIG. 2. In this case, the same parts as in the embodiment according to FIG. 1 are provided with the same reference numerals, and in this respect reference can be made to the description thereof. Only the differences from the embodiment according to FIG. 1 are therefore described in detail below.

In this case a pump unit 23 likewise has a lifting ring 25 which has associated therewith a first thrust plate 27 on one side of the through opening 26 thereof. A second thrust plate 29 is provided on the other side. The second thrust plate 29 has an aperture 39 through which a drive shaft 37 passes. The drive shaft drives a rotor 35 arranged in a pump chamber 31 of the pump unit 23. Vanes 33 are arranged in the rotor 35 in a radially movable manner.

In contrast to the embodiment according to FIG. 1, the first thrust plate 27 is associated with the housing part 9. The second thrust plate 29 is accordingly associated with the other housing part 7. The second thrust plate 29, together with a recess 17 provided with annular steps and the housing part 7 forms a pressure chamber 47. The pressure chamber 47 is connected in terms of flow to a pressure side of the pump chamber 31, so that—during operation of the pump—the operating pressure p0 is present in the pressure chamber 47. In order that no oil can escape out of the pressure chamber 47 between the drive shaft 37 and the housing part 7, the pressure chamber 47 is provided with a continuous sealing unit 57. In addition, a sealing device 59 is associated with the drive shaft 37.

During operation of the pump the operating pressure p0 present in the pressure chamber 47 acts upon the second thrust plate 29, so that a dynamic effect towards the right onto the lifting ring 25 takes place. The outer surface area 25' of the lifting ring 25 transmits force to a radially outer region of the first thrust plate 27. The first thrust plate 27 is supported at its radially inner region on a spacer means 14 which in this case is constructed in the form of a bead 14'. As a result, bending in the manner of a cup spring also takes place in the case of this thrust plate 27. This means that the radially outer region of the first thrust plate 27 is displaced towards the right, as a result of which the radially inner region rests against the rotor 35 and the vanes 43 in a sealing manner. Thus, the formation of a gap between the rotor 35 or the vanes 43 respectively and the first thrust plate 27 is avoided in this case too.

Figure 3:
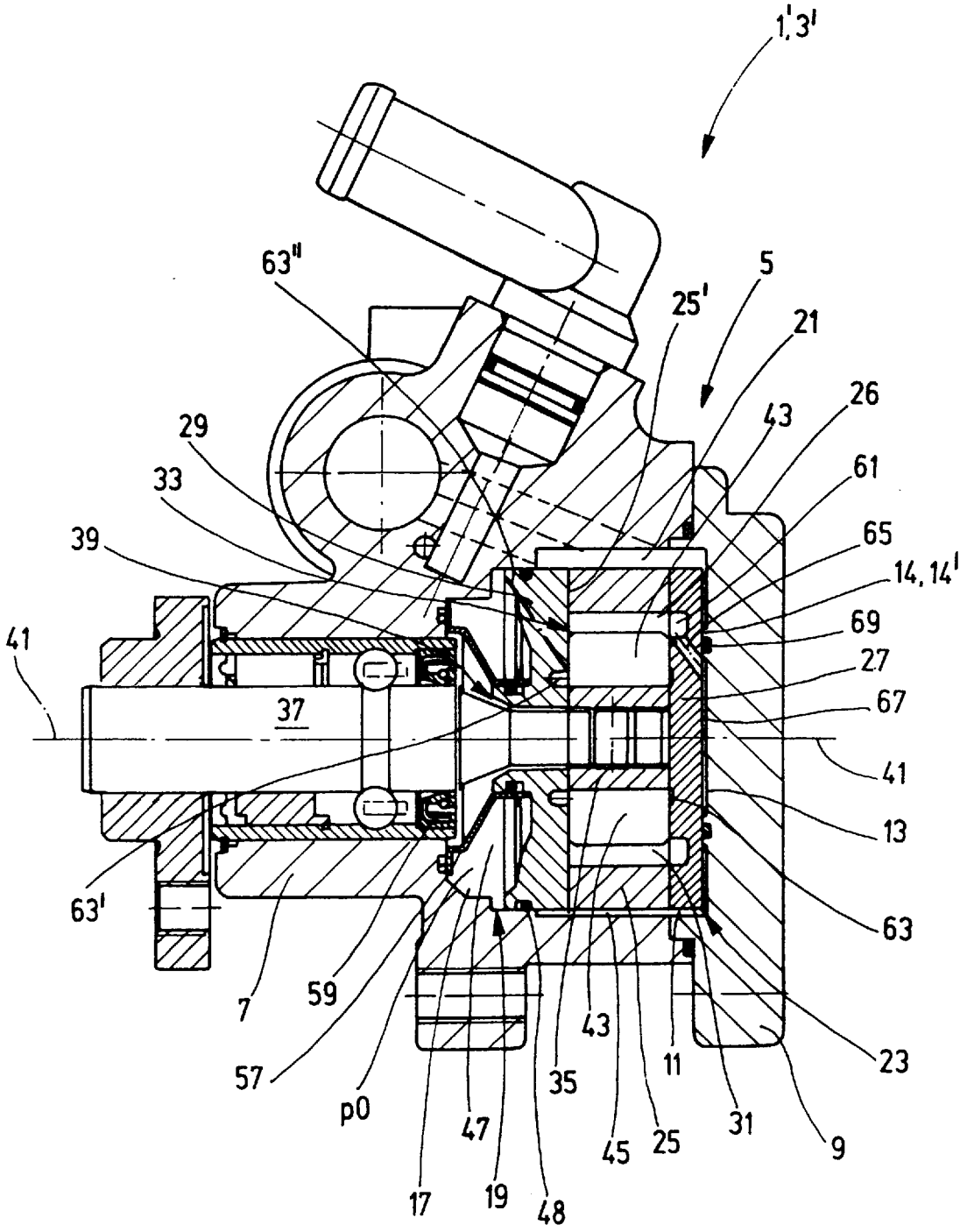

A vane-cell pump 3' is illustrated in FIG. 3. This vane-cell pump 3' differs from the embodiment according to FIG. 2 in that a fluid connection 65 is provided in the first thrust plate 27. The fluid connection 65 extends obliquely inward from a pressure pocket 61 in the direction towards the axis of rotation 41 of the vane-cell pump 3'. The fluid connection 65 thus opens at one end into the pressure pocket 61 and at the other end on the surface of the first thrust plate 27 which faces the base 13 of the cup-shaped recess 11. Since the base 13 is provided with the spacer means 14 or the bead 14', a space 67, which can be acted upon with the operating pressure p0, is formed between the first thrust plate 27 and the base 13. As a result, during operation of the pump 1' the compensation of the gap, produced by the operating pressure p0 present in the pressure chamber 47, is further assisted. In this case, the first thrust plate 27 is acted upon in its radially inner region with the operating pressure p0, so that bending of the first thrust plate 27 in the manner of a cup spring towards the left is assisted. As a result, the compensation of the gap can be assisted hydraulically as a function of the prevailing operating pressure p0. So that oil cannot flow into the recess 11, a continuous seal 69 is inserted in the bead 14'. The seal 69 can also be dispensed with, depending upon the materials used for the housing 5 and the first thrust plate 27.

Alternatively, a fluid connection can also be provided which extends from a continuous annular groove 63 to the space 67. The said continuous annular groove 63 can be at the operating pressure p0 and is used for the so-called under-vane supply of the vanes 43. This means that oil, which is substantially at the operating pressure p0, is introduced below the vanes 43 by way of the annular groove 63 into the slots receiving the vanes 43. Consequently, the outwardly directed movement of the vanes 43 is assisted. The same parts as in FIG. 2 are otherwise provided with the same reference numerals, so that a further description thereof will not be necessary.

Pressure pockets, which can be connected together by way of hydraulic resistance means, may be provided instead of the annular groove 63 for the under-vane supply. A fluid connection is produced primarily in the region opposite the under-vane pockets 63' of the second thrust plate 29 which is connected to the operating pressure p0. The fluid connection 63" (indicated in dash-dot lines) is then produced by at least one pressure pocket, which is substantially at the operating pressure p0, to the space 67. Pressure pockets or an annular groove can of course be provided in the two thrust plates 27 and 29 for the under-vane supply.

Figure 4:
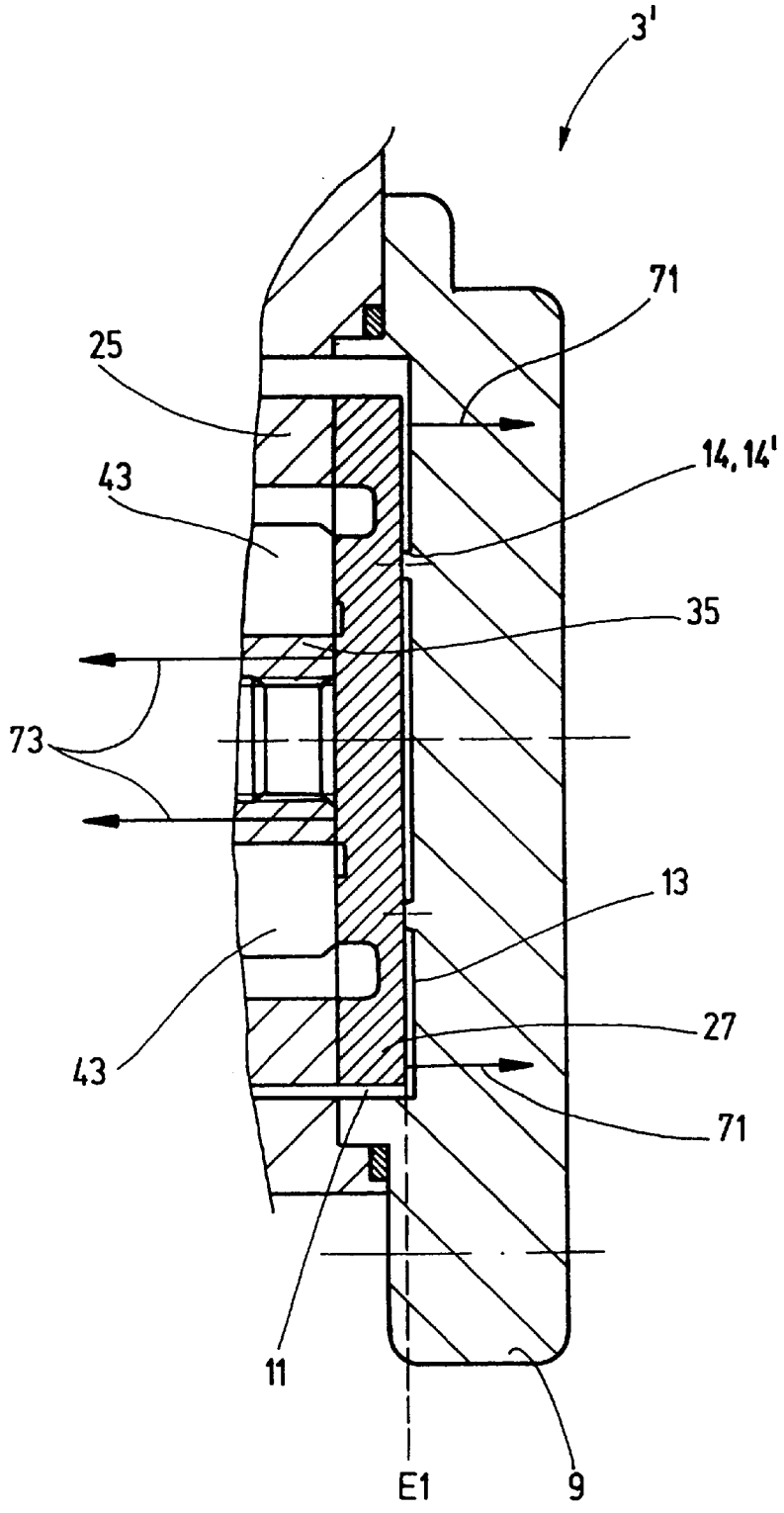
FIG. 4 is an enlarged cut-away view of the pump of FIG. 2.

In FIG. 4 the vane-cell pump 3' according to FIG. 2 is shown enlarged in a cut-away view. In this case it is particularly clear that the first thrust plate 27 rests on the spacer means 14 or the bead 14'. The first thrust plate 27 is thus uniformly spaced from the base 13 of the recess 11, since the said recess 11 rests on a face of the spacer means 14 which is situated in a plane E1. In this way, the first thrust plate 27 can be displaced in the radially outer region thereof in the direction of the arrow 71 during the operation of the pump, in which case the thrust plate behaves like a cup spring. This means that the radially inner region moves in the direction of the arrow 73, so that the formation of a gap between the vanes 43 or the rotor 35 and the thrust plate 27 is prevented during the operation of the pump.

Figure 5:
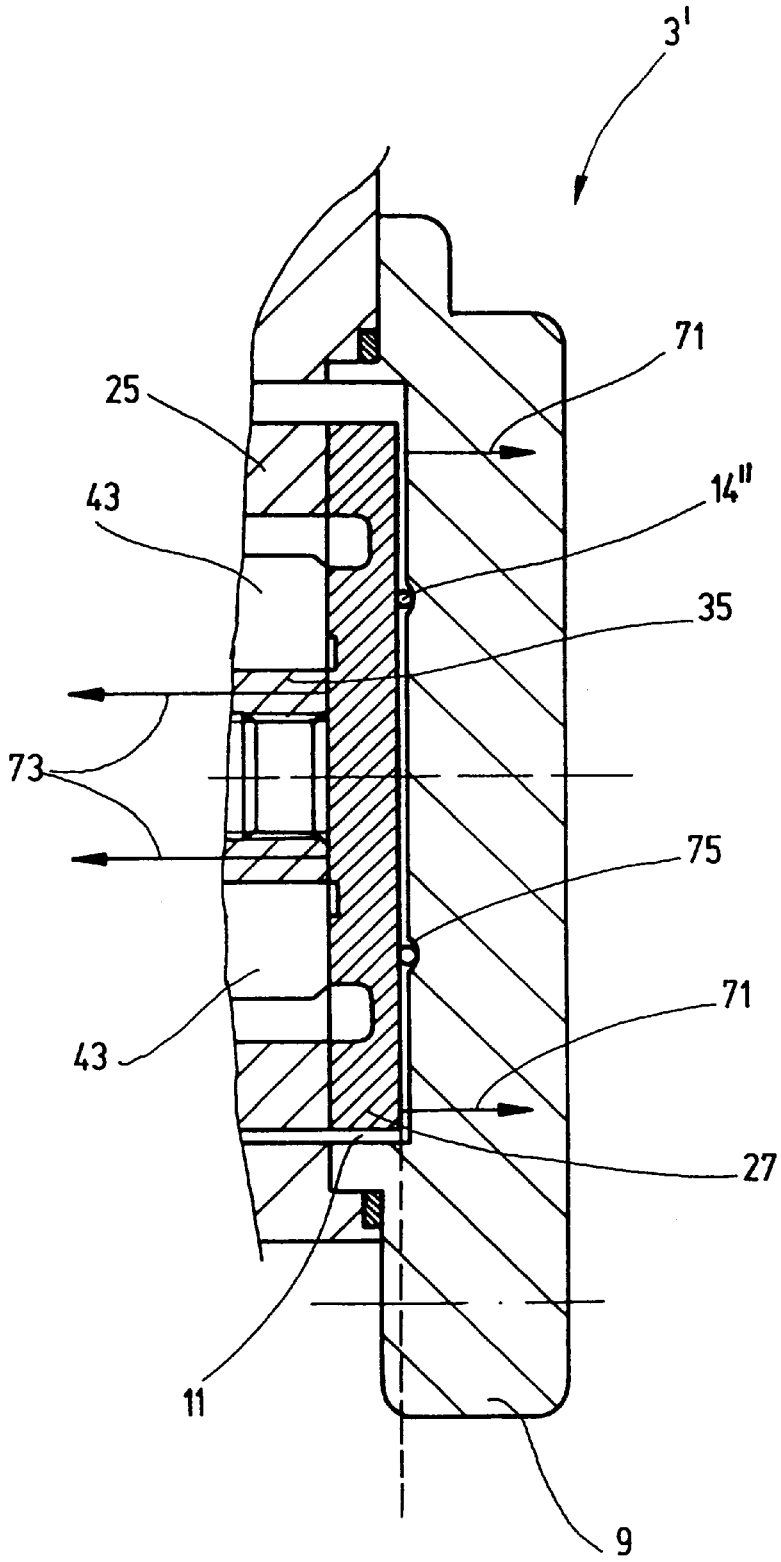
FIG. 5 is an enlarged cut-away view of a further embodiment of a pump.
Figure 6:
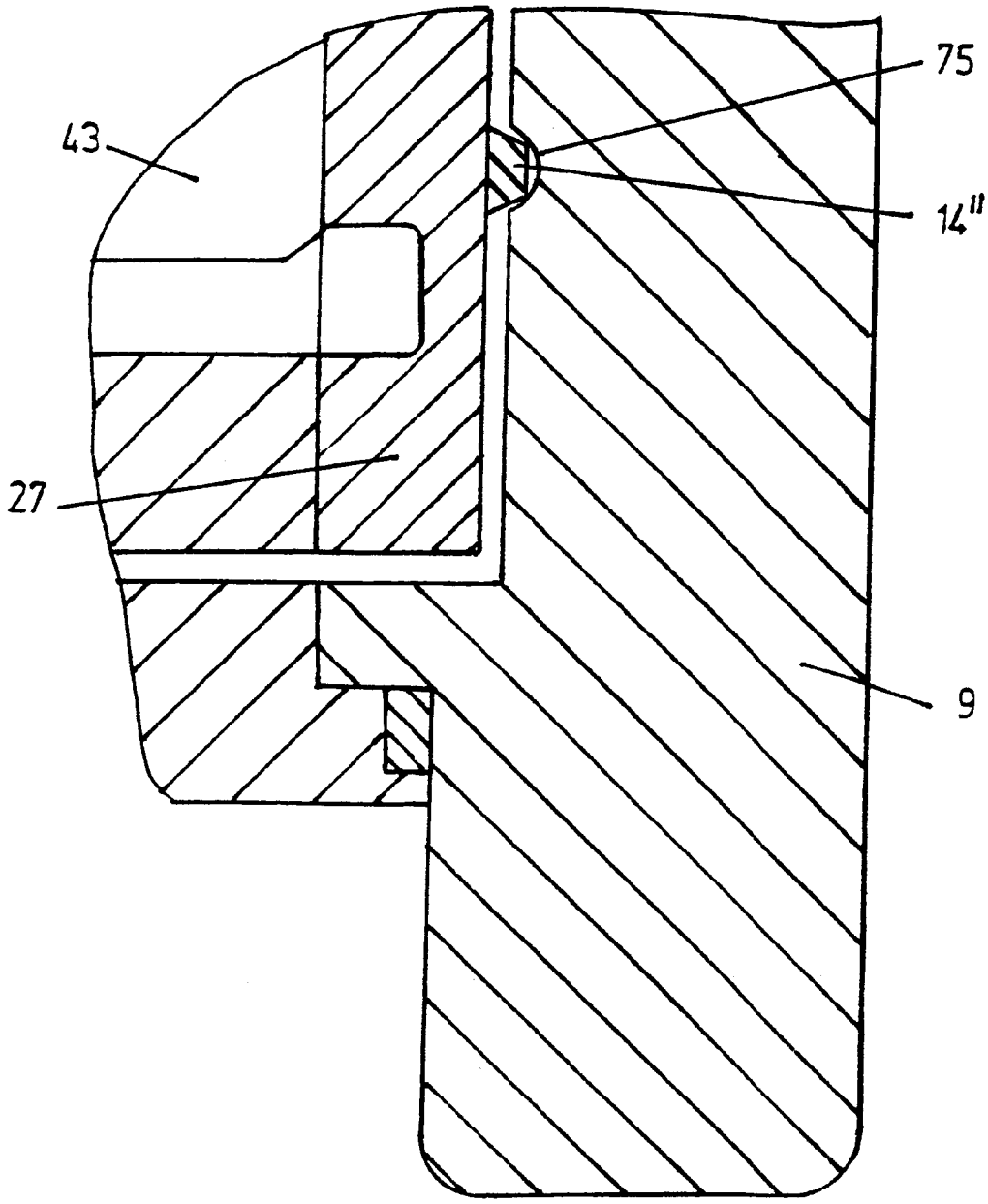
FIG. 6 shows a fragment of the pump with a trapezoidal cross-section spacer ring.

FIG. 5 is an enlarged illustration in a cut-away view of a modified vane-cell pump 3' according to FIG. 2, the spacer means 14 being constructed in this case in the form of a continuous ring 14" which is preferably formed as an open ring and which has a circular cross-section. A continuous hollow 75, in which the ring 14" is situated, is formed in the base 13 of the housing part 9. The hollow 75—as viewed in cross-section—has a substantially semicircular profile. The first thrust plate 27 is supported on the ring 14". During the operation of the vane-cell pump 3' the first thrust plate 27 is bent as already described in conjunction with FIGS. 1 to 4. In this case the ring 14" has the effect that the thrust plate 27 can roll on the open ring 14" during its movement. As a result, the wear of the first thrust plate 27 is reduced. This is particularly advantageous if the pump 1 is subject to particularly frequent changes of load, and thus if the first thrust plate 27' is frequently moved. The same parts are also provided with the same reference numerals as in the other FIGS. 1 to 4. In this respect, reference can be made to the description thereof.

As an alternative to the circular cross-section of the ring 14", it is also possible to use an angular specifically, quandrangular, and in particular a trapezoidal, cross-section. In this case one edge of the ring of angular cross-section rests on the first thrust plate 27. As a result, a preferably circular line of contact is formed between the spacer means or ring and the first thrust plate 27. The desired lever arm, which is present between the line of contact and the outer surface area of the first thrust plate 27, can be predetermined particularly precisely as a result. In particular, it can be provided that the ring is produced from steel. It is therefore possible for the edge of the ring to dig into the thrust plate, as a result of which a sealing effect is achieved. In this case the ring can dig into the thrust plate to such an extent as to achieve a sufficiently slight surface pressing.

It is immediately clear from the above remarks that the spacer means is used so that the first thrust plate is spaced from the housing 5. As a result it becomes possible to deform the first thrust plate in the manner of a cup spring when the ring formed as a lifting ring exerts a force upon the first thrust plate during the operation of the pump. It is also immediately clear that the spacer means can be formed both on the housing and on a thrust plate. The spacer means can also be formed by a separate part, namely the ring. In addition, the height or thickness of the spacer means can of course be varied. Furthermore, the position of the spacer means can also be varied, i.e. the distance of the spacer means with respect to the drive shaft is variable. As a result, it is possible to adjust the effective lever arm.

In addition, with a continuous closed spacer means a sealing effect between the space 67 and the suction chamber 45 is achieved, even when the space 67 has no fluid connection to the pressure region. In the arrangement according to FIG. 1 the space 67 acts as a leakage chamber for oil which has escaped from the pump chamber and which is thus present between the drive shaft 37 and the aperture 39. As a result of the sealing action of the spacer means, oil cannot flow out of the suction chamber 45 into the space 67 during the operation of the pump. The spacer means 14 thus forms a seal between the space 67 and the suction chamber 45. This is particularly important at high rotational speeds of the pump when a particularly large difference in pressure is present between the suction chamber 45 and the space 67.

It is also immediately apparent that the spacer means may be used not only in vane-cell pumps, but also in gear pumps or in so-called cycloid pumps in which the ring of the pump unit is formed by the internally toothed wheel.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A pump comprising a housing and a pump unit arranged therein, the pump unit comprising a first thrust plate, a second thrust plate spaced away from the first thrust plate and a ring arranged between the thrust plates and having a through opening, the ring having an outer peripheral region, at least the outer peripheral region of the ring resting on the first and second thrust plates, a pressure chamber being formed between the second thrust plate and the housing, the first thrust plate having a radially inner surface area radially inward of the outer peripheral region of the ring, the first thrust plate having an inner side toward and an outer side opposite the second thrust plate; and a spacer that supports the first thrust plate at a distance from the housing, the spacer being disposed at the radially inner surface area of the first thrust plate at the outside of the first thrust plate so that during operation, the first thrust plate is deformed and the surface thereof facing the pump chamber is displaced towards the pump insert, thereby substantially preventing formation of a gap between the first thrust plate and the pump insert.

2. A pump according to claim 1, wherein the spacer means has a face situated in a single plane and the first thrust plate rests on the spacer means face.

3. A pump according to claim 1, wherein the housing is comprised of two parts, each housing part having a recess having a depth which is variable.

4. A pump according to claim 2, wherein the spacer means is continuous.

5. A pump according to claim 2, wherein the spacer means is annular.

6. A pump according to claim 5, wherein the radius of the spacer means is variable.

7. A pump according to claim 1, wherein the spacer means is in the form of at least one point-shaped raised portion.

8. A pump according to claim 1, wherein the height of the spacer means is variable.

9. A pump according to claim 1, wherein a space is formed by the first thrust plate, the housing and the spacer means and the space has a connection to a pressure region of the pump.

10. A pump according to claim 9, wherein the spacer means acts as a seal of the space.

11. A pump according to claim 9, further comprising a fluid connection in the first thrust plate connecting the space to the pressure chamber of the pump.

12. A pump according to claim 9, further comprising a medium connection between the space and an under-vane supply.

13. A pump according to claim 11, wherein the fluid connection is arranged radially outwardly in the first thrust plate, and in the operational position of the pump the fluid connection is situated above a median axis of rotation of the pump insert.

14. A pump according to claim 1, wherein the housing has a cup-shaped recess and the spacer means is formed by a bead extending from the base of the cup-shaped recess of the housing.

15. A pump according to claim 14, wherein the bead is provided with a seal.

16. A pump according to claim 1, wherein the spacer means is formed by a bead formed integrally with the first thrust plate.

17. A pump according to claim 16, wherein the bead is provided with a seal.

18. A pump according to claim 1, wherein the spacer means is formed by a ring situated between the base of a recess of the housing and the first thrust plate.

19. A pump according to claim 18, wherein the ring is open.

20. A pump according to claim 18, wherein the ring has a circular cross-section.

21. A pump according to claim 18, wherein the ring has an angular cross-section.

22. A pump according to claim 21, wherein the cross-section of the ring is quadrangular.

23. A pump according to claim 21, wherein the cross-section of the ring is trapezoidal.

24. A pump according to any claim 1, wherein the pump is a vane-cell pump, the ring is a lifting ring, and the pump insert comprises a rotatably mounted rotor having vanes which at least in part are movable radially.

* * * * *